US006106441A

United States Patent [19]

Chen

[11] Patent Number: 6,106,441

[45] Date of Patent: Aug. 22, 2000

[54] HEIGHT ADJUSTABLE FOOT ANCHORING WHEEL ASSEMBLY

[76] Inventor: Ping Chen, No. 29, Nan-Mei St., Taichung City, Taiwan

[21] Appl. No.: 09/391,170

[22] Filed: Sep. 8, 1999

[51] Int. Cl.[7] ..... A63B 22/06

[52] U.S. Cl. ..... 482/57

[58] Field of Search ..... 482/51–53, 57, 482/148, 59, 62, 63–65, 54; 16/19, 27, 45, 46, 18 R; 280/87.1, 642, 647, 87.051, 87.021; 248/129

[56] References Cited

U.S. PATENT DOCUMENTS

| | | | |
|---|---|---|---|
| 4,653,968 | 3/1987 | Rapata et al. | 16/19 |
| 5,453,066 | 9/1995 | Richter | 482/57 |
| 5,651,754 | 7/1997 | Chen | 482/57 |
| 5,916,066 | 6/1999 | Chen | 482/57 |

*Primary Examiner*—Stephen R. Crow
*Attorney, Agent, or Firm*—Ladas & Parry

[57] ABSTRACT

A foot anchoring wheel assembly for a frame body includes an insert member and an anchor wheel. The insert member includes a plug body with an end piece projecting radially outward from an outer end of the plug body, and an engaging member projecting radially outward from the plug body adjacent the end piece so as to confine with the end piece an annular engaging groove. The anchor wheel is sleeved around the insert member and includes a tubular member which has a varying thickness in radial directions, and an annular protrusion projecting radially inward from the tubular member to extend into the engaging groove. A foot tube is inserted between the plug body and the tubular member. A locking notch is formed in the annular protrusion to engage a locking piece formed on the insert member adjacent to the end piece and the engaging member so as to prevent the anchor wheel from rotation relative to the insert member.

6 Claims, 5 Drawing Sheets

HEIGHT ADJUSTABLE FOOT ANCHORING WHEEL ASSEMBLY

BACKGROUND OF THE INVENTION

1. Field of the Invention

The invention relates to a foot anchoring wheel assembly for positioning a frame on a floor, more particularly to a foot anchoring wheel assembly disposed at the foot of a frame, such as a frame of an exercise device, so as to immobilize the frame on a floor.

2. Description of the Related Art

A foot anchoring wheel assembly of the aforementioned type is disclosed in U.S. Pat. No. 5,651,754 which is owned by the Applicant of the current application. The anchoring wheel assembly as disclosed therein includes an insert member inserted fittingly into an open end of a foot tube disposed at the bottom of an exercise device, and a friction wheel sleeved rotatably around the foot tube. Projection means are provided at the inner end of the insert member to engage and prevent the friction wheel from being released from the foot tube and the insert member. The friction wheel is rotatable relative to the insert member and can be immobilized via interlocking means disposed at the inner end of the insert member. In this construction, due to the presence of the projection means at the inner end of the insert member, it is inconvenient to insert or assemble the insert member in the friction wheel.

U.S. Pat. No. 5,916,066 discloses a rotatable wheel assembly which also includes an insert member fitted to an open end of a foot tube disposed at the bottom of an tubular member, and a wheel sleeve rotatably around the foot tube. In this device, engagement means however project from an outer end of the insert member so that the inner end of the insert member can be tapered to ease insertion of the insert member into the wheel. While this device is advantageous in this aspect, as there is not any means for locking the wheel against rotation relative to the insert member, the wheel cannot be used as an anchor wheel.

SUMMARY OF THE INVENTION

An object of the present invention is to provide an improved foot anchoring device of the above-described type in which not only can an insert member be inserted easily into an outer wheel, but the outer wheel can also be locked against rotation relative to the insert member.

According to the present invention, a foot anchoring wheel assembly for a frame body comprises an insert member which includes a plug body with an inner end and an outer end, an end piece that is connected to and covers the outer end of the plug body and that projects radially outward from the outer end of the plug body, and an engaging member projecting radially outward from the plug body adjacent the end piece so as to confine with the end piece an engaging groove that extends around the plug body. The wheel assembly further includes an anchor wheel sleeved around the insert member. The anchor wheel includes a tubular member which has an open end for entrance of the insert member and which has a varying thickness in radial directions, and an annular protrusion projecting radially inward from the tubular member adjacent to the open end to extend into the engaging groove. The annular protrusion defines an opening which is greater than the cross-section of the inner end of the insert member, but smaller than the cross-section of the engaging member. A foot tube which is adapted to be disposed at a bottom of the frame body is inserted between the plug body and the tubular member. The annular protrusion and the engaging groove extend between the foot tube and the end piece. Interlocking means for preventing the anchor wheel from rotating relative to the insert member includes at least one locking notch formed in the annular protrusion, and at least one locking piece formed on the insert member adjacent to the end piece and the engaging member for engagement with the locking notch means.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
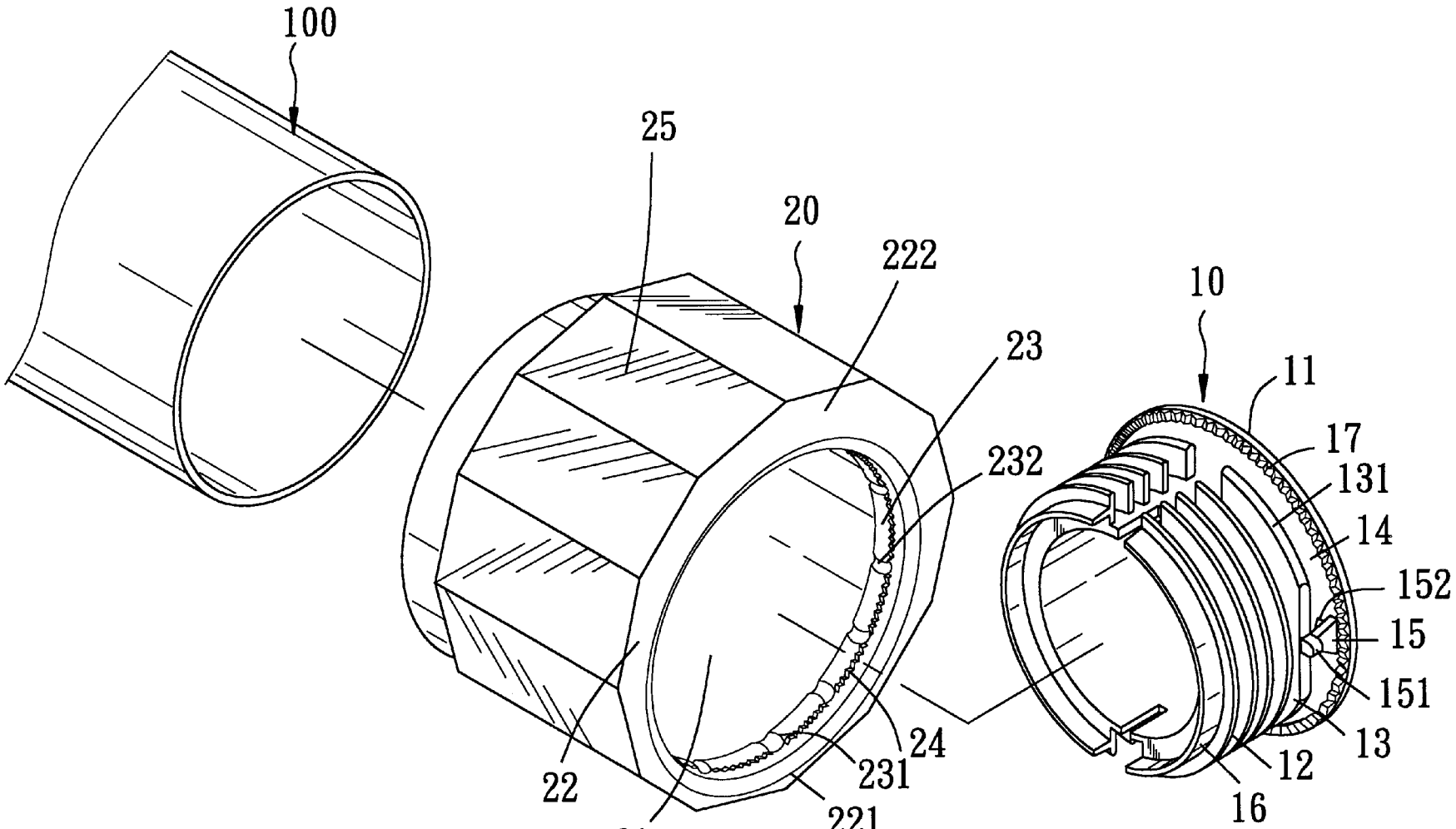
FIG. 1 is an exploded view of an embodiment of the foot anchoring wheel assembly according to the present invention.
Figure 2:
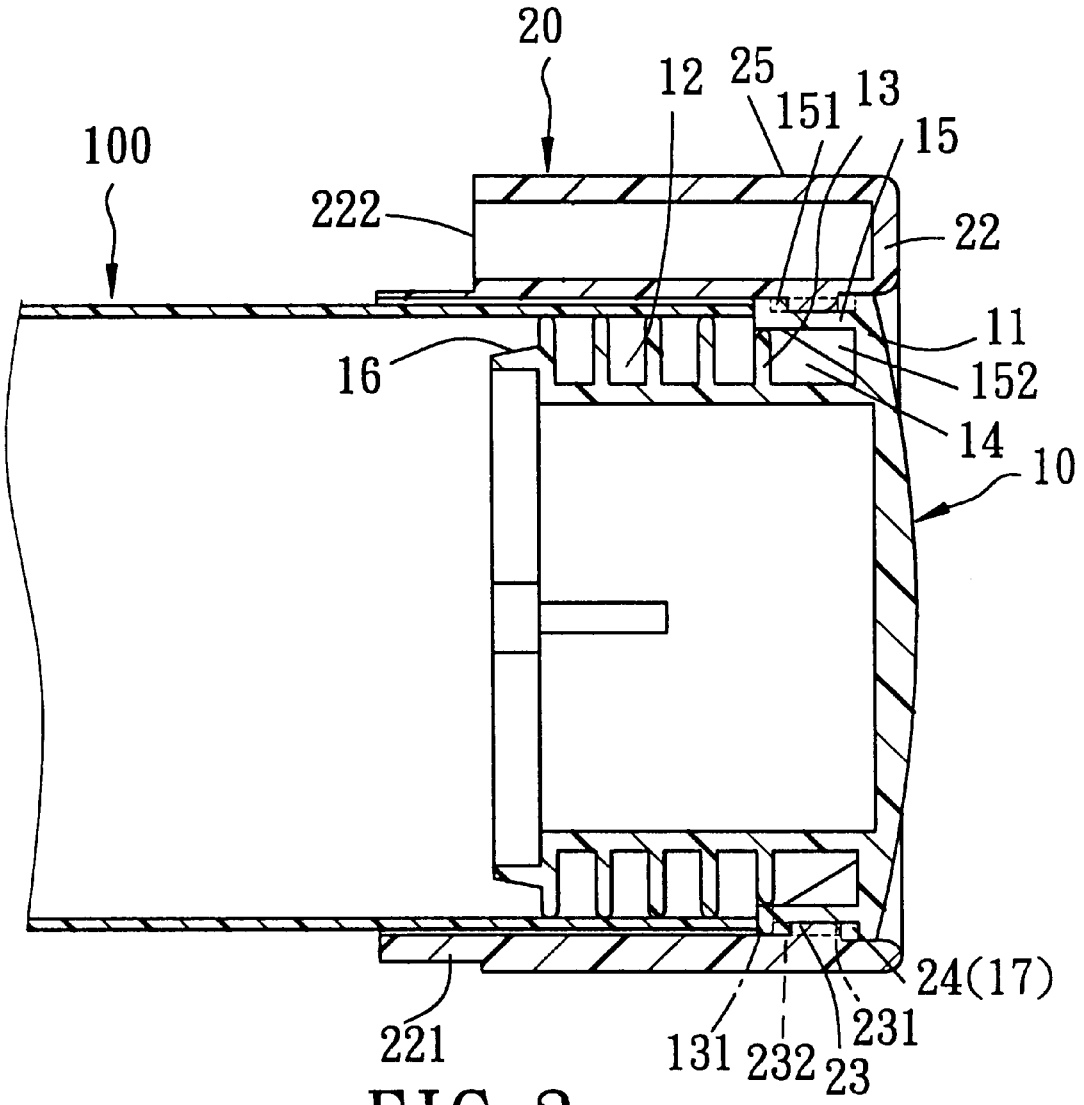
FIG. 2 is a longitudinally cross-sectioned view of the foot anchoring wheel assembly of FIG. 1.

Referring to FIGS. 1 and 2, a foot anchoring wheel assembly is shown to include a foot tube 100 adapted to be disposed at the bottom of a frame of an exercise device (not shown), and an insert member 10 and an anchor wheel 20 which are attached to one end of the foot tube 100.

Figure 4:
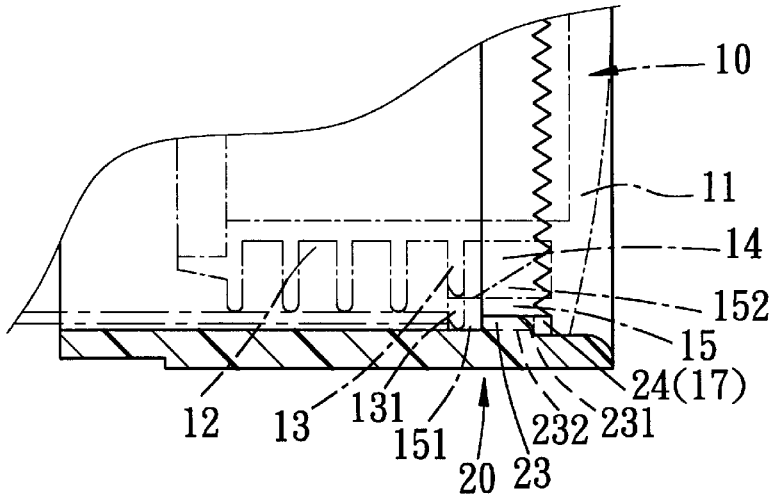
FIG. 4 is a partially cross-sectioned fragmentary view of the foot anchoring wheel assembly of FIG. 1.

The insert member 10 includes a tubular plug body 12 made of a plastic material, and an end piece 11 which is connected to an outer end of the plug body 12 in such a manner that the end piece 11 covers the outer end and projects radially outward from the outer end of the plug body 12. The plug body 12 has a tapered inner end 16. An engaging member 13 extends around and projects radially outward from the plug body 12 adjacent the end piece 11 so as to confine with the end piece 11 an engaging groove 14. A beveled face 131 (as best shown in FIG. 4) is formed on the engaging member 13. A pair of locking plates 15 project axially inward from two diametrically opposite positions of the end piece 11 and extend across the engaging groove 14. Each locking plate 15 has a locking piece 151 which projects outwardly and radially from a distal end of the corresponding locking plate 15, and a triangular reinforcing rib 152 extending from the end piece 11 to reinforce the locking plate 15. The triangular reinforcing rib 152 is connected to the locking plate 15 without extending to the distal end of the locking plate 15 so that the distal end can be flexed limitedly in a radial direction. The engaging member 13 is indented adjacent to the locking pieces 151 so as to permit the latter to move radially inward. A toothed rim 17 is formed on an inner side of the end piece 11 to extend toward the engaging groove 14.

Figure 3:
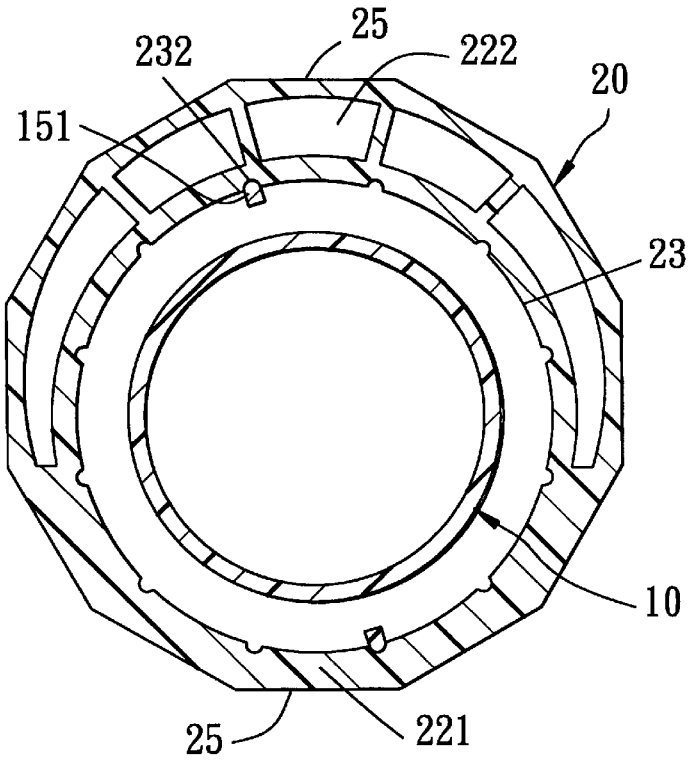
FIG. 3 is a sectional view showing the anchor wheel engaging the locking piece of FIG. 1.

The anchor wheel 20 is sleeved around the insert member 10 and includes a tubular member 22 which has an annular protrusion 23 extending radially inward from an inner wall thereof to extend into the engaging groove 14. The annular protrusion 23 defines an opening 21 which is greater than the cross-section of the tapered inner end 16 of the insert member 10 so that the insert member 10 can be inserted easily into the anchor wheel 20. The opening 21 is however smaller than the cross-section of the engaging member 13. The tubular member 22 has a varying thickness in radial directions so that the outer wall 25 thereof is eccentric with respect to the opening 21 of the insert member 10 (as best shown in FIG. 3). The outer wall 25 is polygonal and thus has a plurality of flat faces to contact the floor on which the foot tube 100 is placed. The thickness increases gradually from a thin portion 221 to a thick portion 222 which is diametrically opposite to the thin portion 221. The annular protrusion 23 has an outer guide face 231 which is inclined inwardly (as best shown in FIG. 4), and a plurality of locking notches 232 spaced apart angularly. Due to the presence of the outer guide face 231 of the annular protrusion 23 and the beveled face 131 of the insert member 10, when a force is applied to the insert member 10 to insert the latter into the anchor wheel 20, the engaging member 13 of the insert member 10 moves past the annular protrusion 23 so that the annular protrusion 23 is received slidably in the engaging groove 14. The annular protrusion 23 is further provided with an annular serrated part 24 extending outwardly of the guide face 231 to engage the toothed rim 17 of the insert member 10.

In assembly, the insert member 10 is first inserted into the anchor wheel 20 through the opening 21 until the engaging member 13 moves past the annular protrusion 23. In this situation, the annular protrusion 23 is received in the engaging groove 14 of the insert member 10. Via a slight turning of the anchor wheel 20 relative to the insert member 10, the locking pieces 151 are placed in engagement with the corresponding locking notches 232 as shown in FIG. 3, thereby locking the anchor wheel 20 against rotation relative to the insert member 10.

The foot tube 100 is then inserted fittingly into a space between the anchor wheel 20 and the insert member 10 through the inner end 16 of the insert member 10 until the open end of the foot tube 100 contacts the engaging member 13. The insert member 10 and the anchor wheel 20 are therefore positioned relative to the foot tube 100. The interengagement between the serrated part 24 and the toothed rim 17, as shown FIG. 4 increases the effect of holding the anchor wheel 20 against the insert member 10.

Figure 5:
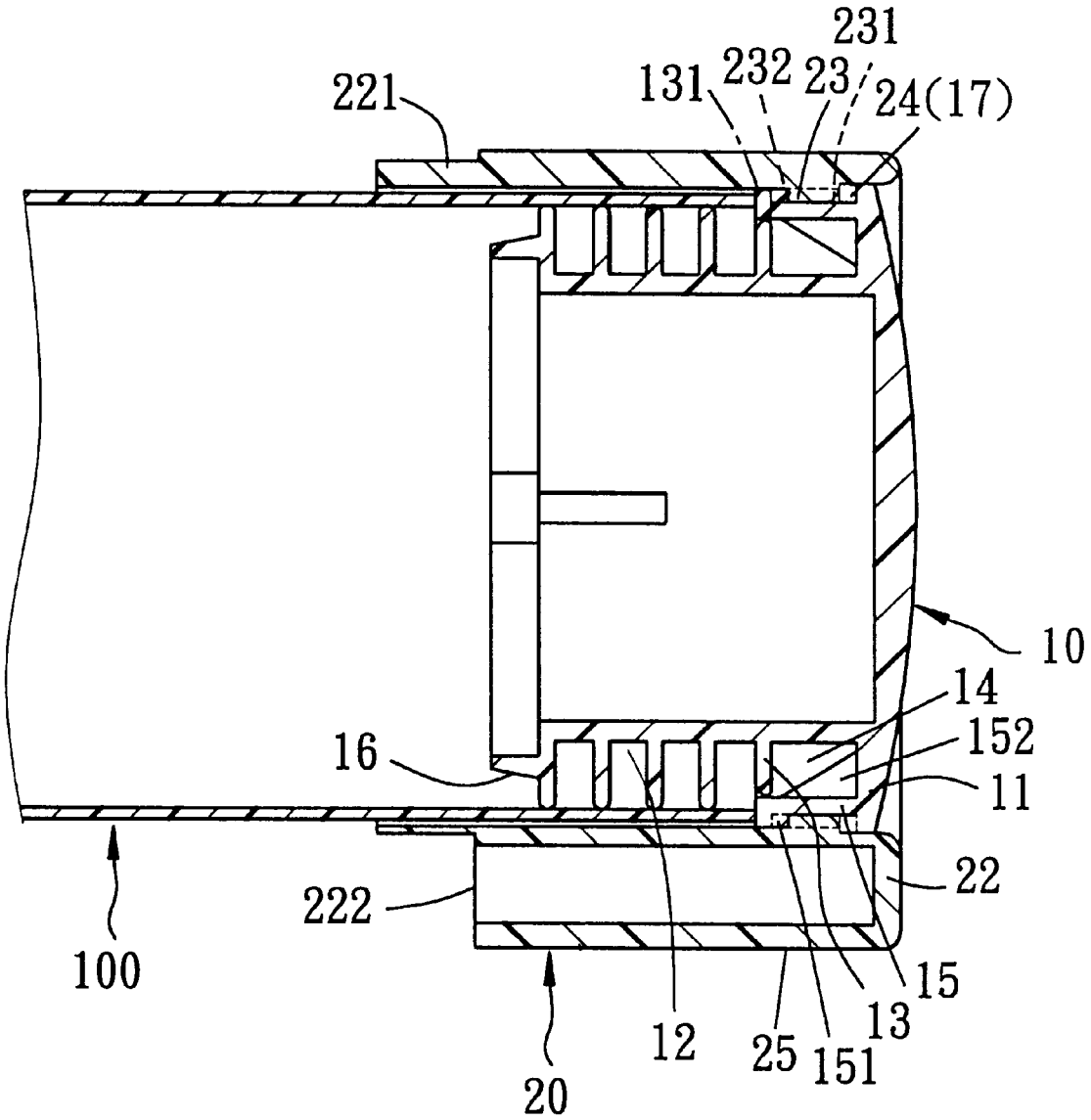
FIG. 5 is a sectional view similar to FIG. 2 but in a different position.

When the floor on which the foot tube 100 is placed is uneven, the foot tube 20 can be raised from the floor by rotating the anchor wheel 20 relative to the insert member 10 to turn downward the thick portion 222 as shown in FIG. 5. The anchor wheel 20 is permitted to rotate relative to the insert member 10 when the force applied to the anchor wheel 20 is sufficiently large to separate the serrated part 24 from the toothed rim 17 and to move the locking pieces 151 out of the corresponding locking notches 232 by virtue of the resilient property of the distal ends of the locking plates 15.

Figure 6:
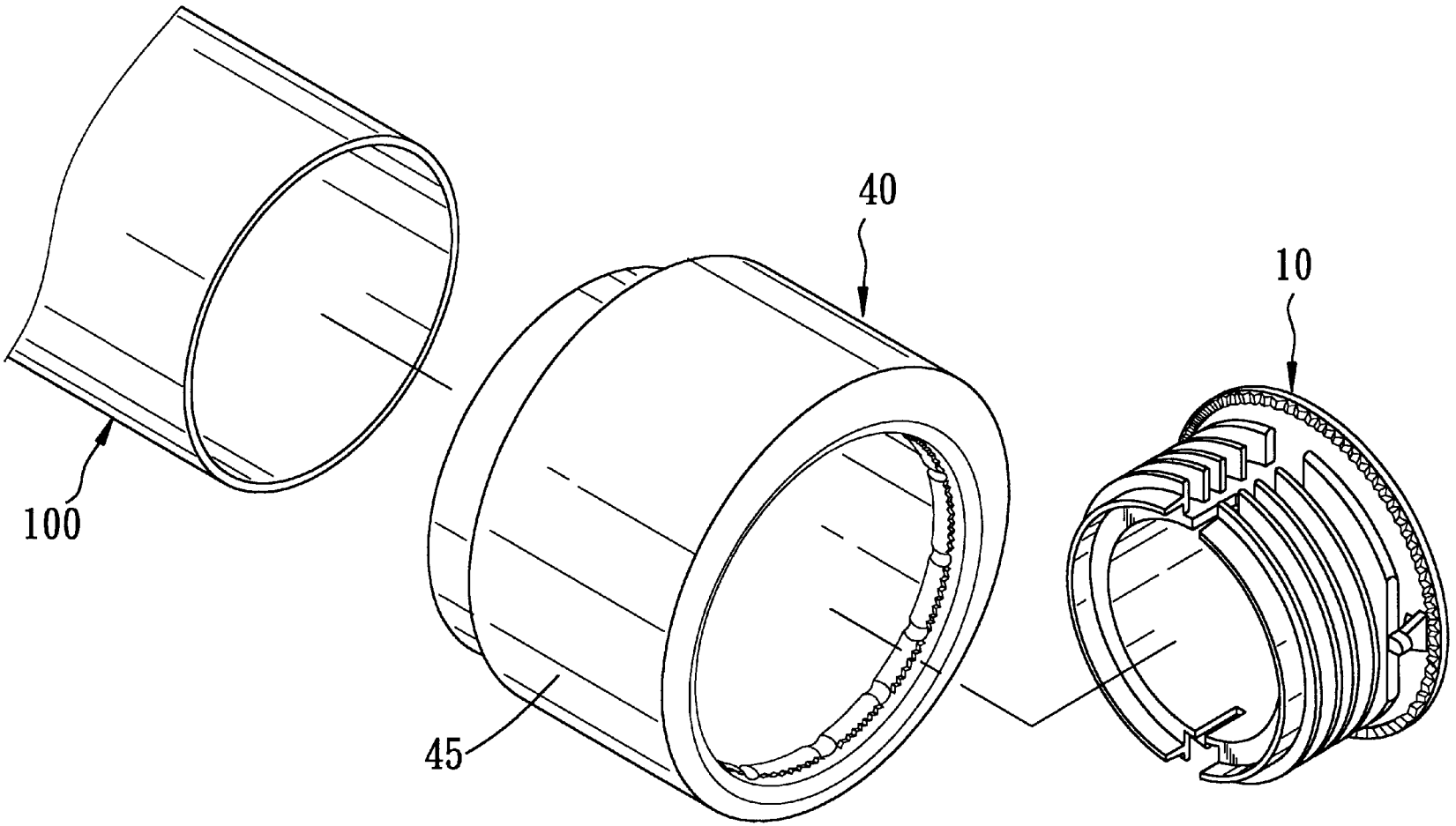
FIG. 6 shows another embodiment of the foot anchoring wheel assembly according to the present invention.

FIG. 6 shows another embodiment of the foot anchoring wheel assembly according to the present invention, which differs from the embodiment shown in FIGS. 1–5 in that the outer wall 45 of the anchor wheel 40 is circular rather than polygonal.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What I claim is:

1. A foot anchoring wheel assembly for a frame body, comprising:

an insert member including a plug body with an inner end and an outer end, an end piece which is connected to and covers said outer end of said plug body and which projects radially outward from said outer end of said plug body, and an engaging member projecting radially outward from said plug body adjacent said end piece so as to confine with said end piece an engaging groove that extends around said plug body;

an anchor wheel sleeved around said insert member and including a tubular member which has an open end for entrance of said insert member and which has a varying thickness in radial directions, and an annular protrusion projecting radially inward from said tubular member adjacent to said open end to extend into said engaging groove, said annular protrusion defining an opening which is greater than the cross-section of said inner end of said insert member, but smaller than the cross-section of said engaging member;

a foot tube adapted to be disposed at a bottom of the frame body, said foot tube being inserted between said plug body and said tubular member, said annular protrusion and said engaging groove extending between said foot tube and said end piece; and interlocking means for preventing said anchor wheel from rotating relative to said insert member, said interlocking means including at least one locking notch formed in said annular protrusion, and at least one locking piece formed on said insert member adjacent to said end piece and said engaging member for engagement with said locking notch.

2. The foot anchoring wheel assembly as claimed in claim 1, wherein said interlocking means includes a plurality of said locking notches extending radially and spaced apart angularly in said annular protrusion, said locking piece extending radially from said insert member to engage selectively one of said locking notches.

3. The foot anchoring wheel assembly as claimed in claim 2, wherein said interlocking means includes a pair of said locking pieces which are opposed diametrically.

4. The foot anchoring wheel assembly as claimed in claim 2, wherein said end piece includes a locking plate which extends axially inward from said end piece across said engaging groove, said locking piece being formed on a distal end of said locking plate.

5. The foot anchoring wheel assembly as claimed in claim 4, wherein said end piece further includes a triangular reinforcing rib extending axially from said end piece to reinforce said locking plate, said reinforcing rib being connected to said locking plate without extending to said distal end so as to render said distal end flexible.

6. The foot anchoring wheel assembly as claimed in claim 2, further comprising an annular serrated part formed on said annular protrusion, and a toothed rim formed on said end piece and extending toward said engaging groove to engage said annular serrated part.

* * * * *